United States Patent [19]

Cheng

[11] Patent Number: 4,809,353

[45] Date of Patent: Feb. 28, 1989

[54] CARRIER WITH SIMULTANEOUS FORMATION OF CARRYING HANDLE AND DECORATIVE BOW

[76] Inventor: Peter S. C. Cheng, 5 Ross Street, Toronto, Ontario, Canada, M5T 1Z8

[21] Appl. No.: 100,446

[22] Filed: Sep. 24, 1987

[51] Int. Cl.[4] ..... B65D 33/00

[52] U.S. Cl. ..... 383/6; 383/14; 383/26; 428/4

[58] Field of Search ..... 428/4, 5; 383/6, 26, 383/14

[56] References Cited

U.S. PATENT DOCUMENTS

| | | | |
|---|---|---|---|
| 1,468,711 | 9/1923 | Dwyer | 383/6 |
| 2,841,905 | 9/1958 | Wanchek | 428/5 |
| 3,637,455 | 1/1972 | Pearson et al. | 428/4 |
| 4,127,155 | 11/1978 | Hydorn | 383/26 |
| 4,515,837 | 5/1985 | Cheng | 428/4 |
| 4,608,283 | 8/1986 | White | 428/4 |
| 4,656,064 | 4/1987 | Cheng | 428/4 |

FOREIGN PATENT DOCUMENTS

| | | | |
|---|---|---|---|
| 230182 | 3/1925 | United Kingdom | 383/26 |

*Primary Examiner*—Stephen P. Garbe

*Attorney, Agent, or Firm*—Kirschstein, Kirschstein, Ottinger & Israel

[57] ABSTRACT

A decorative bow and a carrying handle are simultaneously formed on a container for carrying the container and an object received therein in a decorative carrier.

18 Claims, 3 Drawing Sheets

FIG. 4
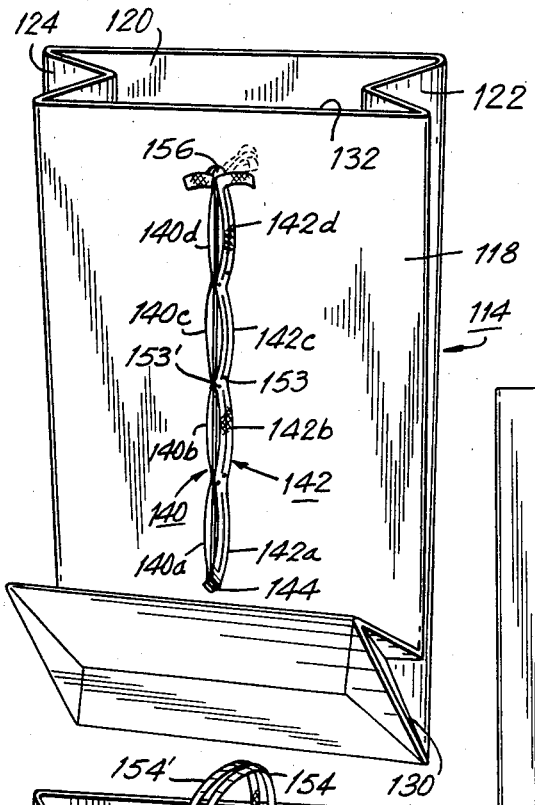
FIG. 5
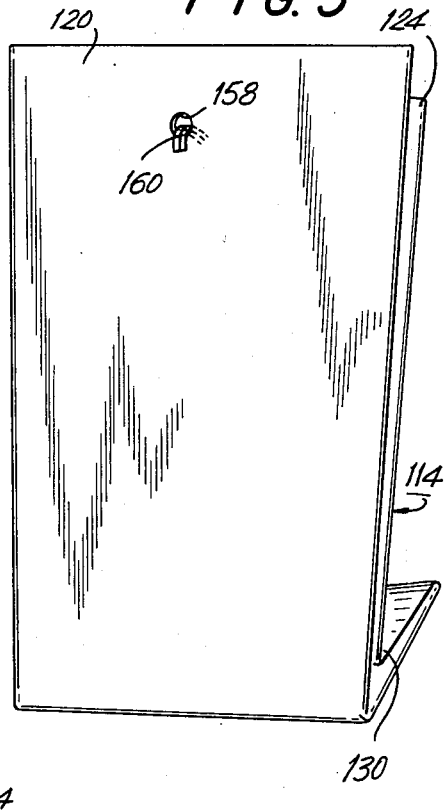
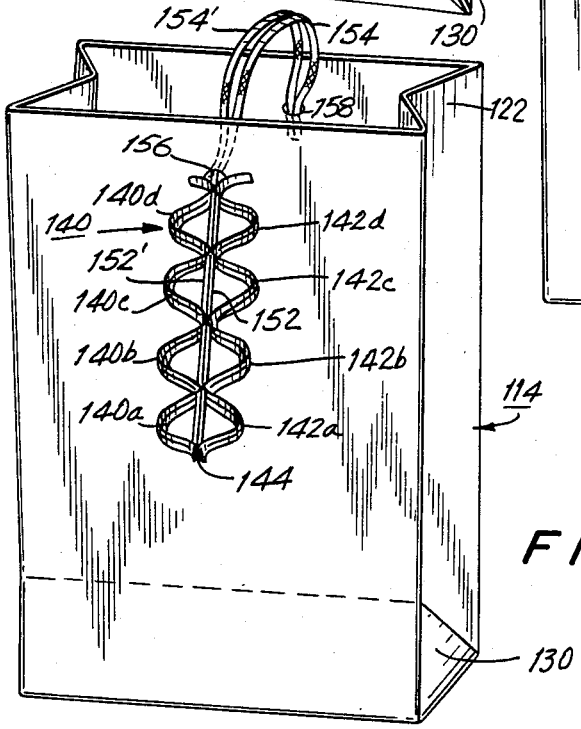
FIG. 6

CARRIER WITH SIMULTANEOUS FORMATION OF CARRYING HANDLE AND DECORATIVE BOW

BACKGROUND OF THE INVENTION

1. Field of the Invention

This invention generally relates to a decorative carrier for carrying an object and, more particularly, to a carrier, such as a bag, being simultaneously formed with a decorative bow and a carrying handle.

2. Description of Related Art

Self-forming bows for attachment to packages are already known, as shown, for example, in U.S. Pat. Nos. 4,515,837; 4,476,168; 2,956,362 and 2,841,905. It is also known to integrate self-forming bows with gift-receiving bags; see, for example, U.S. Pat. No. 4,608,283.

However, such gift-receiving bags have not been integrated with carrying handles for carrying the bags from place to place. A need exists for a ready-to-carry package for receiving gift objects or the like, which package can be formed without any specific skills or talent, not only into an attractive package adorned with a decorative bow, but also with a carrying handle ready to be transported and delivered as a gift for any occasion, with a minimum of fuss and bother. The need also exists for such a package to lie flat for ease of storage, shipment and display in the non-carrying state so that a minimum of space is utilized.

SUMMARY OF THE INVENTION

1. Objects of the Invention

It is an object of this invention to overcome the drawbacks of the prior art.

Another object of this invention is to meet the need for gift-receiving bags to be integrated not only with a self-forming bow, but also with a carrying handle.

Another object of this invention is to provide a gift package which is easily formed, without any specific skills or talent, into a decorative carrier.

2. Features of the Invention

In keeping with these objects, and others which will become apparent hereinafter, one feature of this invention resides, briefly stated, in a decorative carrier arrangement comprising an article to be carried, as well as bow means and actuator means, both means being mounted on the article and together operative for simultaneously forming not only a decorative bow on the article, but also a carrying handle to carry the article from place to place with the decorative bow thereon. The method of simultaneously forming the bow and the handle is also within the scope of this invention.

In a preferred embodiment, the article is a container, e.g. a shopping bag, in which a gift object or the like is received. The bow means is separate from or integral with the container and is mounted for movement relative to the container from a bow-unformed position to a bow-formed position. The actuator means is operatively connected to the bow means, and moves the bow means from the bow-unformed to the bow-formed position, thereby forming the decorative bow and the carrying handle at the same time.

The bow means may be of many different constructions. Preferably, a pair of bow ribbons may be juxtaposed and arranged in a generally collapsed state in the bow-unformed position. The bow ribbons may be joined, e.g. by retaining clips, at spaced-apart locations lengthwise of the ribbons to form a plurality of elongated bow sections, each section having opposite ends which are drawn together in the bow-formed position to form a circular array or rosette or individual folded loops or petals which together constitute the bow.

The drawing action is performed by the actuator means, which is preferably constituted by a drawstring having an actuating portion and a handle portion. The actuating portion extends between the bow ribbons and is operatively connected to a common end of the bow ribbons in the bow-unformed position. The handle portion may overlie one wall of the container, or extend between opposing walls of the container, in the bow-unformed position, also conveniently termed a noncarrying position. In the bow-formed position, also conveniently termed a carrying position, the handle portion is elevated above an upper opening of the bag and, either by itself, or with another carrying handle, constitutes the means by which the container is carried.

To effect movement between the non-carrying and carrying positions, the handle portion is grasped and pulled by an operator, thereby also pulling the actuator portion. The pulling of the actuator portion causes each bow section to fold and form a loop, and draws said common end of the bow ribbons toward an opposite end of the drawstring which is stationarily mounted on the container. The drawstring may be a single element or twin elements.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 4 is analogous to FIG. 1, but of another embodiment;

FIG. 5 is a rear perspective view of the FIG. 4 embodiment;

FIG. 6 is a front perspective view of the FIG. 4 embodiment during formation of a decorative bow and a carrying handle;

DETAILED DESCRIPTION OF THE PREFERRED EMBODIMENTS

Figure 2:
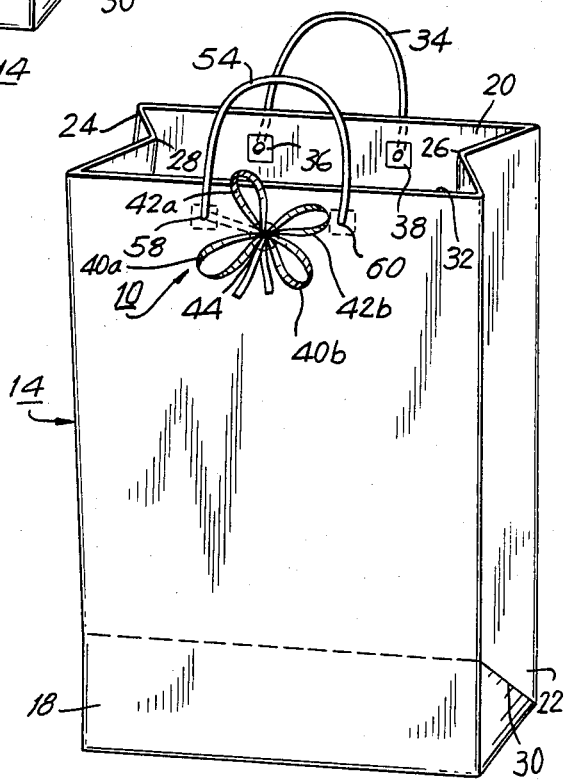
FIG. 2 is a front perspective view of the arrangement of FIG. 1 in a bow-formed position.

As best shown in FIG. 2, a decorative bow 10 and a carrying handle 12 are simultaneously formed on an article 14 to be carried. As shown, the article 14 is a container, preferably a shopping bag made of paper, plastic and like materials, although the invention is not intended to be so omitted since any carryable container or article is within the spirit of this invention. An object 16 (see FIG. 7), such as a gift item, is contained within the bag 14 for delivery and presentation with the decorated carrier bag 14.

The bag 14 has a front wall 18, a rear wall 20, a pair of side walls, 22, 24 each foldable about upright longitudinal creases 26, 28, a closed bottom wall 30, and a top opening 32 through which the object 16 passes into and out of the bag. The bag 14 is of the expandible type. Initially, the bag is in a collapsed state with the front 18 and rear 20 walls lying flat against each other, and with the top opening 32 closed. When the front and rear walls are moved away from each other, the top opening 32 is opened, thereby allowing access to the interior of the bag through the top opening 32.

As will be explained in detail below, the rear wall 20 is provided with a pre-formed carrying bail 34 whose opposite ends 36, 38 are fixedly anchored at an upper marginal edge region of the rear wall 20.

Figure 1:
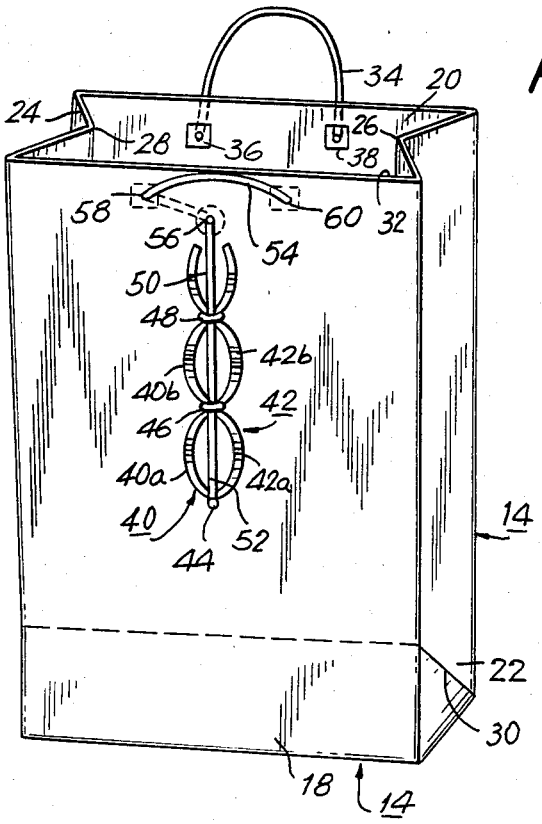
FIG. 1 is a front perspective view of a decorative carrier arrangement in a bow-unformed position in accordance with one embodiment of the invention.

Bow means, including a pair of bow ribbons 40, 42, are suspended freely from an upper marginal edge region of the front wall 18. The ribbons 40, 42 may be two separate ribbons tied together at common end 44, or, preferably, a single ribbon folded over at common end 44. Retainers or clips 46, 48 are mounted at an angle relative to the elongation of the bow ribbons at spaced-apart locations along the ribbons 40, 42 to form a plurality of elongated bow sections 40*a*, 42*a* and 40*b*, 42*b*. Each clip gathers the ribbons into close confinement, and forms each bow section with opposite ends. Each ribbon is made of a material separate from that of the bag 14. The ribbons are supported by the bag for movement relative to the bag walls from a bow-unformed, generally collapsed, position (see FIG. 1) to a bow-formed, generally three-dimensional, looped position (see FIG. 2).

Actuator means, including a drawstring 50 having an actuating portion 52 and a handle portion 54, is mounted on the bag and is operatively connected to the bow means. In operation, as explained below, the actuator means is operative to simultaneously form the bow 10 and the carrying handle 12

In the bow-unformed position, the actuating portion 52 extends between the ribbons and passes loosely through the clips 46, 48. One end region of the actuating portion is connected and tied with a knot to the common end 44 of the ribbons. The actuator portion and the ribbons are suspended as an integral assembly at the exterior of the bag. The other end region of the actuator portion is routed through a first aperture 56 into the interior of the bag, and extends in one transverse direction along part of the upper marginal edge portion of the front wall 18 before being routed outwardly through a second aperture 58 to the exterior of the bag. At this point, the handle portion of the drawstring extends in an opposite transverse direction to and past the first aperture 56 along the upper marginal edge portion of the front wall. The handle portion has an end 60 which is stationarily mounted on, and exteriorly of the front wall.

Figure 3:
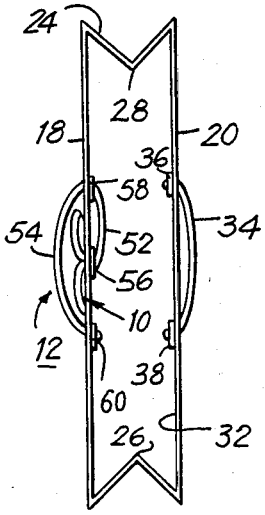
FIG. 3 is a top plan view of the arrangement of FIG. 2.

In use, an operator need only grasp and pull on the handle portion to effect relative movement between the handle portion and the front wall. The stationary end 60 is fixed and cannot move; however, the common end 44 is free to move, and moves toward the front wall. During this movement, the actuating portion 52 slides through the inclined clips 46, 48, and folds the opposite ends of each bow section toward each other, thereby forming individual loops which tend to be rotated about the elongations of the bow ribbons and together form a circular array constituting the bow. The actuating portion 52 also passes through the first 56 and second 58 apertures and adds its length to the handle portion 54, thereby forming the carrying handle 12 which, in its final state, has a contour and size corresponding to that of the carrying bail 34. The carrying bail 34 and the carrying handle 12 together serve as means for carrying the bag 14 and the object 16 from place to place. The bail and handle lie in generally parallel planes relative to the rear and front walls, and are elevated above the upper opening 32 of the bag. As shown in FIG. 3, the bail and handle do not obstruct the opening 32, and permit free access of the object into and out of the bag.

In a variant embodiment, the bail 34 need not be pre-formed, but can be another carrying handle formed by the bow means and actuator means described above, in which case, decorative bows 10 will be formed at both sides of the bag.

FIGS. 4–7 show another embodiment wherein a pre-formed bail is not attached to the bag, and wherein a carrying handle spans the upper opening of the bag and lies in a central plane generally perpendicular to that of the front and rear walls of the container. Thus, bag 114, just like bag 14, includes front 118, rear 120, right side 122, left side 124, and bottom 130 walls bounding an upper opening 132 which is closed or opened upon movement of the front and rear walls toward and away from each other.

Bow means, including a pair of juxtaposed wider, outside bow ribbons 140, 142, extend from a common movable end 144 in a sliding super-imposed relationship to a pair of juxtaposed, narrower, interior, drawstring ribbons having actuator portions 152, 152′ and handle portions 154, 154′. All four ribbons are stapled, knotted or bonded together at common end 144. The bow ribbons 140, 142 are stapled or bonded together at spaced locations 151 along their marginal edges, such as by pairs of bonds, staples, clips or analogous fasteners, 153, 153′, each pair being located at an angle to the axis or elongation of the bow ribbons. The bow ribbons are divided into four pairs of bow sections 140*a*, 142*a*; 140*b*, 142*b*; 140*c*, 142*c*; and 140*d*, 142*d*, by each pair of fasteners 153, 153′.

As shown in FIG. 4, the bow ribbons 142, 142 and the actuator portions 152, 152′ dangle freely in a generally collapsed state outside the bag adjacent the front wall 118. This assembly could have been initially located within the bag, and removed therefrom just prior to forming a decorative bow and carrying handle. The drawstring ribbons extend through a first aperture 156 formed at an upper marginal edge region of the front wall, span the upper opening 132, and terminate in an end 160 (see FIG. 5) which extends through a second aperture 158 formed at an upper marginal edge region of the rear wall. The end 160 is stationarily mounted behind the rear wall, e.g. by gluing.

Figure 7:
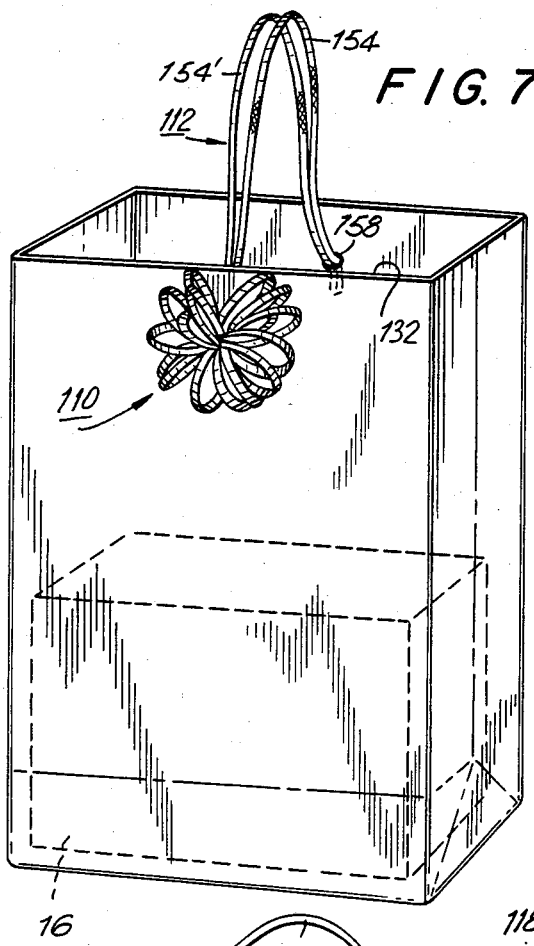
FIG. 7 is a front perspective view of the arrangement of FIG. 4 in a bow-formed position.

In order to form the bow 110 and the carrying handles 112 of FIG. 7, the operator need only grasp the handle portions 154, 154′ and effect relative movement, e.g. by pulling, between the handle portions and the front wall. The handle portions get effectively longer, and the actuating portions get effectively shorter. The actuating portions slide relative to the bow ribbons, and each bow section is folded and slightly rotated about the respective axis of the bow ribbons, thereby forming a circular array of loops for the bow 110. The carrying handles 112 advantageously are located in a central longitudinal plane for better support of the item 16 carried therein.

Figure 8:
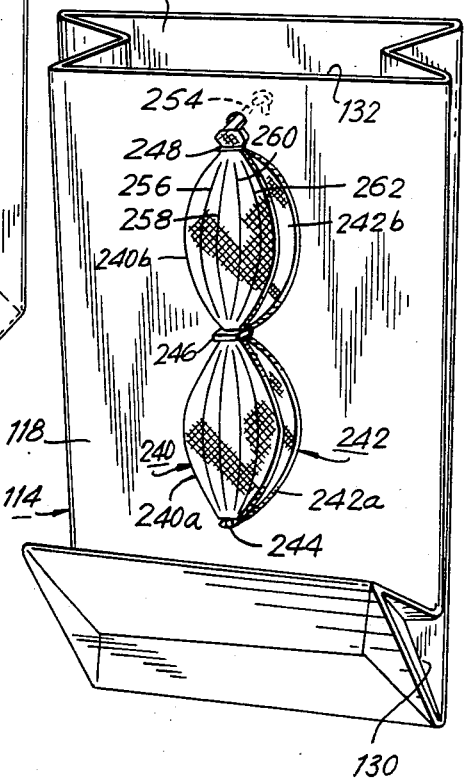
FIG. 8 is analogous to FIG. 1, but of still another embodiment.
Figure 9:
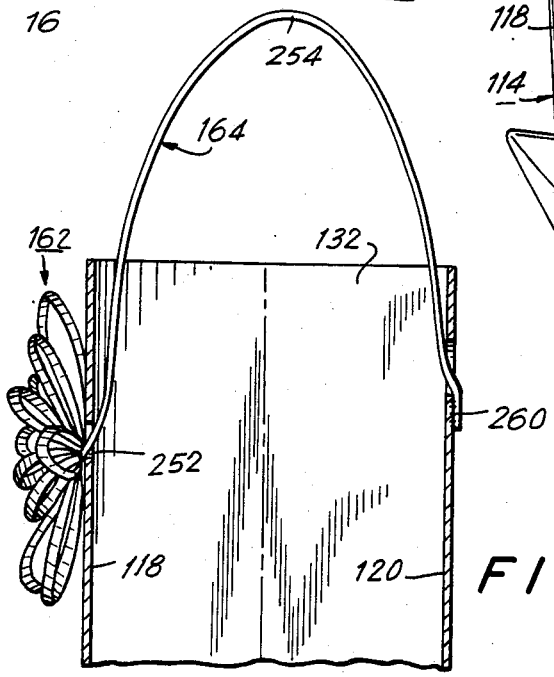
FIG. 9 is an upper sectional view of the embodiment of FIG. 8 in the bow-formed position.

In still another variant construction, FIGS. 8 and 9 illustrate a bag identical to that described and illustrated in connection with FIGS. 4–7, but with a different bow and drawstring construction for forming the bow 162 and single carrying bail 164 (see FIG. 9). Like reference numerals have been employed to identify like parts of the bag.

As for the bow and drawstring construction shown in FIG. 8, a pair of bow ribbons 240, 242 are juxtaposed with each other and lie flat against the front wall 118 of the bag. The bow ribbons 240, 242 are connected by inclined clips 246, 248 to form two pairs of bow sections 240*a*, 242*a*; 240*b*, 242*b*. The ribbons are joined at common end 244 at which an actuator portion 252 of a drawstring is also joined. The actuator portion 252 extends between the bow ribbons and merges with a handle portion 254 of the drawstring. The opposite end 260 of the handle portion 254 is fixed to the rear of the rear wall 120.

In contrast to the previous bow and drawstring constructions, the bow ribbons 240, 242 do not have linear edges, but, instead, have scalloped edges. Each bow ribbon is not a narrow, rectangular strip, but, instead, consists of a plurality of oval sections. In FIG. 8, two oval sections for each ribbon generally resemble the numeral eight.

Furthermore, each bow section is not a single continuous piece of ribbon material, but, instead, is slit along curved slits 256, 258, 260, 262 so that each section is formed of a plurality of loop-forming elements. Upon the relative movement of the drawstring relative to the bow ribbons, each bow section will not fold into a single loop, as described above, but, instead, will fold into a plurality of loops. The result is more folded loops and a "fuller" bow 162, with less travel for the drawstring. This is of particular advantage in the case of forming a carrying handle with a part of the drawstring since, in some constructions, an overlong carrying handle may be unwieldy.

In another variant, the bow means need not be separate from the container, but is integral therewith. For example, upper marginal portions of the container walls can be slit to form elongated loop-forming elements. The drawstring can be operatively connected to the loop-forming elements to fold each element into an individual loop at the upper opening of the container.

In still another variant, the bow means need not constitute a single pair of bow ribbons, but can constitute a plurality of pairs of bow ribbons, each formable by different drawstrings or the same drawstring to achieve a bow having multiple loops.

It will be understood that each of the elements described above, or two or more together, also may find a useful application in other types of constructions differing from the types described above.

While the invention has been illustrated and described as embodied in a carrier with simultaneous formation of carrying handle and decorative bow, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A decorative carrier arrangement, comprising:

(a) an article to be carried;

(b) a bow having individual bow portions mounted on the article for movement relative to the article from a bow-unformed position to a bow-formed position; and (c) means for forming a carrying handle on the article, and for simultaneously forming the bow, including an actuator, mounted on the article for movement relative to the article, and having one actuating portion operatively connected to the bow portions, for moving the bow portions from the bow-unformed position to the bow-formed position to form the bow on the article, and another actuating portion stationarily connected to the article, for simultaneously forming the carrying handle to carry the article from place to place with the bow thereon.

2. The decorative carrier arrangement of claim 1, wherein the article is a container having walls bounding an interior in which an object is received, and wherein the actuator forms the bow and the carrying handle on the container.

3. The decorative carrier arrangement of claim 2, wherein said walls of the container bound an open top; and wherein the actuator means forms the decorative bow and the carrying handle adjacent the open top of the container.

4. The decorative carrier arrangement of claim 2, wherein the bow portions are separate from, and movable relative to, the walls of the container.

5. The decorative carrier arrangement of claim 4, wherein the bow portions include a pair of bow ribbons arranged in a generally collapsed state in the bow-unformed position, and in a three-dimensional state in the bow-formed position; and wherein the actuator means includes an elongated drawstring connected to the bow ribbons and operative, when pulled, to move the bow ribbons into the three-dimensional state.

6. The decorative carrier arrangement of claim 5, wherein the bow ribbons are suspended from one of the walls of the container in the bow-unformed position.

7. The decorative carrier arrangement of claim 5, wherein each bow ribbon includes at least one elongated bow section having opposite ends spaced apart in the bow-unformed position, and wherein the drawstring, when pulled, moves the opposite ends of each bow section together to fold each bow section into a loop in the bow-formed position.

8. The decorative carrier arrangement of claim 7, wherein said bow ribbons are joined at spaced-apart locations to form a plurality of elongated bow sections arranged successively at least partly lengthwise along the drawstring.

9. The decorative carrier arrangement of claim 7, wherein each bow section has a plurality of slits to form a plurality of loop-forming elements.

10. The decorative carrier arrangement of claim 3, wherein the drawstring includes said one actuating portion extending between the bow ribbons in the bow-unformed position, and a handle portion juxtaposed with one of the walls in the bow-unformed position.

11. The decorative carrier arrangement of claim 10, wherein the drawstring has one stationary end anchored to the container, and one movable end connected to the bow ribbons.

12. The decorative carrier arrangement of claim 11, wherein the drawstring is solely mounted on said one wall of the container, said one wall having guide apertures through which the drawstring is routed.

13. The decorative carrier arrangement of claim 12, wherein the handle portion is elevated above said one wall of the container in an intended position of use and generally lies in a plane parallel to said one wall in the bow-formed position to form the carrying handle; and further comprising a carrying bail mounted on another wall of the container in opposing generally parallel relation to the carrying handle, said carrying handle and said carrying bail being clear of the open top of the container.

14. The decorative carrier arrangement of claim 11, wherein the stationary end of the drawstring is anchored to another wall of the container in opposing relation to said one wall, said drawstring spanning the open top of the container between the two opposing walls thereof.

15. A decorative carrier arrangement, comprising:

(a) an article to be carried;

(b) a decoration separate from, and supported by, the article for movement relative to the article from an unformed position to a formed position; and (c) means for forming a carrying handle on the article, and for simultaneously forming the decoration, including an actuator mounted on the article for movement relative to the article, and having one actuating portion operatively connected to the decoration, for moving the decoration from the unformed position to the formed position to form the decoration on the article, and another actuating portion stationarily connected to the article, for simultaneously forming the carrying handle to carry the article from place to place with the decoration thereon.

16. A decorative carrier arrangement, comprising:

(a) a container for receiving an object to be carried, said container having walls bounding an upper opening through which the object passes into and out of the container;

(b) a bow including a pair of bow ribbons mounted on the container walls for movement relative to the container walls from a bow-unformed position in which the bow ribbons are arranged in a generally collapsed state adjacent one of the walls of the container, to a bow-formed position in which the bow ribbons are arranged in a three-dimensional state on said one wall adjacent the upper opening; and (c) means for forming a carrying handle on the container, and for simultaneously forming the bow, including an actuator including a drawstring mounted on the container for movement relative to the container walls, and having one actuating portion operatively connected to the bow ribbons, for moving the bow ribbons from the collapsed state to the three-dimensional state to from the bow on the container and another actuating portion stationarily connected to the container, for simultaneously forming the carrying handle above the upper opening in an intended position of use to carry the object inside the container from place to place with the bow on the container.

17. A method of simultaneously forming a decorative bow and a carrying handle on an article to be carried about, comprising the steps of:

(a) providing a bow with individual bow portions on the article for movement relative to the article from a bow-unformed position to a bow-formed position; and (b) moving the individual bow portions from the bow-unformed position to the bow-formed position to form the bow on the article, and to simultaneously form a carrying handle to carry the article from place to place with the bow thereon, said moving step being performed by operatively connecting one actuating portion of an actuator to the bow portions, by stationarily connecting another actuating portion of the actuator to the article, and by mounting the actuator on the article for movement relative to the article.

18. The method of claim 17, wherein said moving step is performed by manually pulling the actuator.

* * * * *